United States Patent [19]

Masuch et al.

[11] Patent Number: 4,641,771

[45] Date of Patent: Feb. 10, 1987

[54] METHOD AND APPARATUS FOR SUPPLYING WRAPPING MATERIAL TO CIGARETTE PACKING AND LIKE MACHINES

[75] Inventors: Gerhard Masuch; Claus Riedel, both of Hamburg, Fed. Rep. of Germany

[73] Assignee: Hauni-Werke Körber & Co. KG., Hamburg, Fed. Rep. of Germany

[21] Appl. No.: 711,446

[22] Filed: Mar. 13, 1985

[30] Foreign Application Priority Data

Mar. 29, 1984 [DE] Fed. Rep. of Germany ..... 3411610

[51] Int. Cl.[4] ..... B65B 11/32; B65B 19/22; B65B 41/12; B65H 20/10

[52] U.S. Cl. ..... 226/115; 53/55; 226/95; 242/75.51

[58] Field of Search ..... 226/45, 93, 95, 113, 226/115, 108, 117; 242/75.51; 53/55

[56] References Cited

U.S. PATENT DOCUMENTS

| | | | |
|---|---|---|---|
| 3,033,433 | 5/1962 | Kottman et al. | 226/108 |
| 3,122,332 | 2/1964 | Hughes, Jr. | 226/118 X |
| 3,140,030 | 7/1964 | Stewart | 226/95 |
| 3,355,166 | 11/1967 | Plumb | 226/95 |
| 3,730,811 | 5/1973 | Wendt | 242/58.4 |
| 3,956,870 | 5/1976 | Kruse et al. | 53/55 |
| 4,344,690 | 8/1982 | Viehrig et al. | 242/75.51 X |
| 4,489,872 | 12/1984 | Bolton et al. | 226/117 |

FOREIGN PATENT DOCUMENTS

| | | |
|---|---|---|
| 2205366 | 8/1972 | Fed. Rep. of Germany . |
| 3114470 | 2/1982 | Fed. Rep. of Germany . |

*Primary Examiner*—Stuart S. Levy
*Assistant Examiner*—Lynn M. Sohacki
*Attorney, Agent, or Firm*—Peter K. Kontler

[57] ABSTRACT

Wrapping material which is supplied from a reel to the intermittently actuated withdrawing tongs of a cigarette packing machine is looped in a magazine adjacent to the tongs and is stabilized against fluttering and other stray movements by a pneumatic conveyor which attracts one leg of the loop and tensions it so that such leg of the loop remains in its prescribed path.

18 Claims, 3 Drawing Figures

METHOD AND APPARATUS FOR SUPPLYING WRAPPING MATERIAL TO CIGARETTE PACKING AND LIKE MACHINES

BACKGROUND OF THE INVENTION

The present invention relates to a method and apparatus for manipulating web- or strip-shaped materials, especially for supplying such materials to processing machines. Typical examples of processing machines which utilize web- or strip-shaped wrapping materials are cigarette packing machines wherein arrays of e.g., four, five, ten, twenty or twenty-one cigarettes are confined in wrappers consisting of paper, tinfoil, synthetic plastic material or a combination of two or more envelopes.

It is already known to convert the leader of a strip of wrapping material into a loop prior to delivery into the processing machine. Reference may be had to German Offenlegungsschrift No. 22 05 366 or to German Offenlegungsschrift No. 31 14 470. These publications disclose apparatus wherein the loop at the leading end of a strip of wrapping material is introduced into a magazine at a continuously varying or variable speed, and successive increments of the loop are intermittently withdrawn from the magazine for admission into the processing machine. In order to hold the loop in the magazine, the apparatus which are disclosed in the German publications further comprise suction generating means for attracting the bight of the loop.

A drawback of the aforedescribed conventional apparatus is that their operation is unsatisfactory when the frequency at which increments of the wrapping material must be withdrawn from the magazine exceeds a certain value. The strip is then agitated to such an extent that it can affect the accuracy and predictability of withdrawal of increments of preselected length and cause improper operation of the processing machine. This can result in the making of a large number of defective packs and in a pronounced reduction of the output of the processing machine, e.g., a high-speed cigarette packer which turns out several hundred packs per minute.

OBJECTS AND SUMMARY OF THE INVENTION

An object of the invention is to provide a novel and improved apparatus for supplying strips or webs of wrapping or like material to processing machines at any desired practical frequency without affecting the accuracy and predictability of admission of the material into the processing machine.

Another object of the invention is to provide the apparatus with novel and improved means for eliminating or at least strongly damping stray movements of a strip of wrapping or like material on its way to a processing machine which receives the material at a certain frequency rather than continuously.

A further object of the invention is to provide the apparatus with novel and improved means for damping or preventing stray movements of the conveyed material in the magazine which stores a length of such material in the form of a loop.

An additional object of the invention is to provide the apparatus with novel and improved means for synchronizing the movements of various mobile units so as to ensure a predictable rate of material feed into the magazine.

Still another object of the invention is to provide a novel and improved loop forming magazine for use in the above outlined apparatus.

An additional object of the invention is to provide an apparatus which allows for high-frequency or low-frequency withdrawal of predetermined lengths of strip-shaped material from the magazine wherein the material is confined in the form of a loop.

Another object of the invention is to provide a novel and improved method of supplying strip- or web-shaped material, especially webs of tinfoil, paper or the like, to a high-speed processing machine, such as a cigarette packing machine.

A further object of the invention is to provide a novel and improved method of preventing or reducing the extent of stray movements of looped strip- or web-shaped material in the magazine of the above outlined apparatus.

Another object of the invention is to provide a method which ensures that the integrity of the conveyed material is not affected by the selected frequency at which predetermined lengths of the material must be withdrawn from a magazine wherein the leader of the material is stored in the form of a loop.

The improved apparatus is utilized to supply strip- or web-shaped wrapping material to a processing machine, particularly to a cigarette making machine, and comprises a source of wrapping material (e.g., a bobbin of convoluted tinfoil, paper or the like), a magazine, means for feeding wrapping material from the source into the magazine and for converting the wrapping material in the magazine into a loop (the configuration of the magazine may be such that it promotes the formation of a loop therein), and means for intermittently withdrawing wrapping material from the magazine with attendant changes in the dimensions of the loop and a tendency of the loop to become agitated (such tendency is more pronounced when the frequency at which the wrapping material is being drawn from the magazine increases, e.g., to satisfy the requirements of a packing machine which turns out four hundred or more cigarette packs per minute). The magazine has a portion (preferably an upstanding sidewall) which is adjacent to a part of the loop therein, and the improved apparatus further comprises means for opposing agitation of the loop. Such opposing means is adjacent to the aforementioned portion of the magazine and acts upon the aforementioned part of the loop. The loop in the magazine has a bight which is or can constitute the lowermost portion of the loop and two legs which flank the bight. One of these legs preferably constitutes the aforementioned part of the loop.

The opposing means preferably constitutes or comprises an endless foraminous conveyor one side of which is adjacent to the aforementioned portion (sidewall) of the magazine, and means (e.g., a suction chamber) for pneumatically urging the aforementioned part or leg of the loop against the aforementioned side of the conveyor. The suction chamber is connected to the intake of a fan or another suitable suction generating device.

The apparatus preferably further comprises means for driving the conveyor at a speed which preferably slightly exceeds the speed at which the feeding means delivers wrapping material into the magazine so that the conveyor maintains the aforementioned part or leg of the loop under tension (to this end, the conveyor is driven in a direction to advance the wrapping material in the direction in which the material is being delivered by the feeding means). The conveyor can comprise one or more endless foraminous belts and the apparatus preferably further comprises means (e.g., a battery of sensors in the form of proximity detectors) for monitoring the dimensions of the loop in the magazine, preferably in the region of the aforementioned portion or sidewall of the magazine. The sensors are preferably disposed one after the other, as considered in the direction of feed of wrapping material into the magazine. The conveyor can comprise a single and preferably wide endless foraminous belt having a stretch which is adjacent to the sidewall of the magazine and means for pneumatically attracting the aforementioned part of the loop to such stretch; the monitoring means is then adjacent to one side of the stretch. Alternatively, the conveyor can comprise two relatively narrow endless foraminous belts whose stretches flank the monitoring means.

The source of wrapping material can be disposed at a level above the magazine and the latter is then formed with an open top for admission of wrapping material into its interior. Such magazine is formed with a bottom wall which causes the admitted wrapping material to develop a bight adjacent to the bottom wall and two legs adjacent to two sidewalls forming part of the magazine, extending upwardly from and disposed at the opposite sides of the bottom wall. Each leg of the loop in the magazine is adjacent to the inner side of a different sidewall. That leg which is adjacent to the aforementioned portion or sidewall of the magazine travels downwardly toward the bottom wall, and the withdrawing means can comprise a tongs which is constructed, mounted and operated to intermittently draw predetermined lengths of the other leg of the loop through the open top of the magazine.

The feeding means can comprise a pair of rotary advancing elements and the apparatus can further comprise means for driving the conveyor or conveyors as well as for driving at least one of the rotary advancing elements in synchronism with the conveyor. The driving means is preferably adjustable by the aforementioned monitoring means as a function of changes in the dimensions of the loop in the magazine.

Another feature of the invention resides in the provision of a method of supplying strip-shaped wrapping material to a processing machine, such as a cigarette packing machine. The method comprises the steps of establishing and maintaining a source of supply of wrapping material (e.g., a reel of convoluted wrapping material), feeding the wrapping material from the source at a variable speed along a predetermined path and converting the leader of the advancing wrapping material into a loop having a bight and two legs or flanges flanking the bight, intermittently drawing wrapping material from one leg of the loop with attendant changes in the dimensions of the loop and a tendency of the loop to become agitated, and opposing such agitation of the loop including maintaining the other leg of the loop in the respective portion of its path. The maintaining step can include pneumatically urging the other leg of the loop into the respective portion of the path, tensioning the other leg of the loop in such portion of the path and/or conveying the other leg of the loop along the respective portion of the path at a speed which deviates from the variable speed. The method can further comprise the step of monitoring the dimensions of the loop and varying the speed at which the wrapping material is being fed from the source as a function of changes in the dimensions of the loop.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
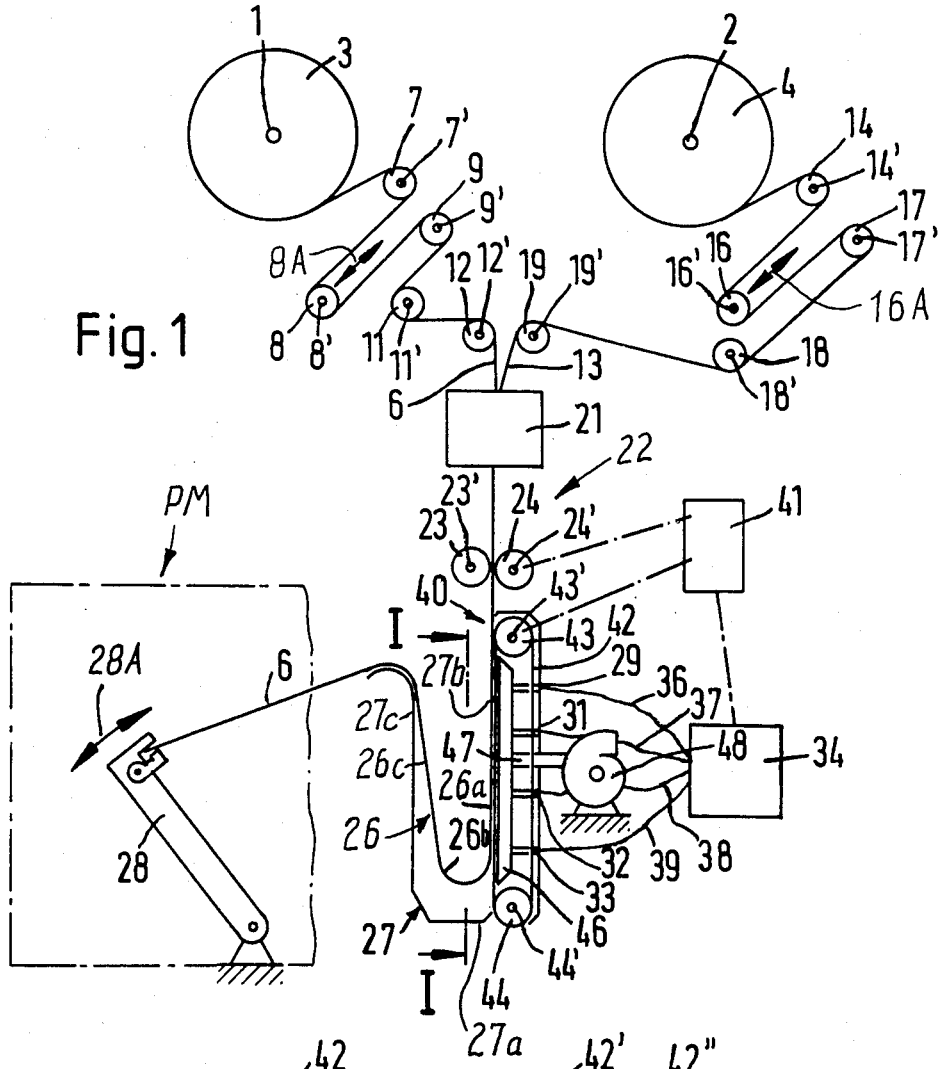
FIG. 1 is a schematic elevational view of the improved apparatus.

The apparatus which is shown in FIG. 1 includes a source 3 of wrapping material 6, such as a web of tinfoil or paper, which is a reel or bobbin rotatably mounted on a horizontal shaft 1. The material 6 is advanced along a meandering path by the rotary elements 23, 24 of a feeding unit 22. The meandering path is defined by a set of rollers 7, 8, 9, 11 and 12 which are respectively mounted on parallel horizontal shafts 7', 8', 9', 11' and 12'. The roller 8 is a dancer roller which is movable in the directions indicated by a double-headed arrow 8A to maintain the wrapping material 6 under requisite tension. The rotary elements 23, 24 are respectively mounted on parallel shafts 23', 24' and serve to advance the wrapping material 6 at a variable speed through a conventional splicing device 21 (e.g., a device disclosed in the commonly owned U.S. Pat. No. 3,730,811 granted May 1, 1973 to Wendt). A spare reel or bobbin 4 is held in a position of readiness on a shaft 2 and the leader of its web or strip 13 is trained over a set of rollers 14, 16, 17, 18, 19 and is located in the splicing device 21 so that it can be attached to the trailing end of the wrapping material 6 as soon as the supply of such material on the reel 3 is exhausted. The rollers 14, 16, 17, 18, 19 are respectively mounted on parallel shafts 14', 16', 17', 18' and 19'. The roller 16 is a dancer roller, i.e., it is movable with the shaft 16' in directions which are indicated by a double-headed arrow 16A to maintain the web 13 under requisite tension.

When the supply of wrapping material 6 on the reel 3 is exhausted and the trailing end of the material 6 is spliced to the leader of the web 13, the remnant of the reel 3 is removed and is replaced with a fresh reel (not shown). The leader of convoluted wrapping material on such fresh reel is threaded into the splicing device 21 in the same way as shown for the web 13 so as to be in a position of readiness for attachment to the trailing portion of the web 13. This ensures an uninterrupted feed of the wrapping material along a predetermined path which extends into and is defined in part by an upright open-top magazine 27 cooperating with the feeding unit 22 to convert the leader of the running web or strip of wrapping material into a loop 26 having a bight **26*b*** flanked by two elongated legs or parts 26*a*, 26*c* which are respectively adjacent to the corresponding portions or sidewalls 27*b*, 27*c* of the magazine 27. The bottom wall 27*a* of the magazine 27 is adjacent to the bight 26*b* of the loop 26. The speed of the rotary advancing element 23 and/or 24 is variable by a driving unit 41 which is adjustable by a monitoring unit including a row of four aligned sensors 29, 31, 32, 33 (e.g., proximity detectors of any known design) and an evaluating circuit 34 which is connected to the outputs of the sensors 29, 31, 32, 33 by conductor means 36, 37, 38, 39 and whose output is connected to the adjustable driving unit 41. The sensors 29, 31, 32, 33 monitor the length of the part or leg 26*a* of the loop 26 in the region of the sidewall 27*b* of the magazine 27 and generate signals which are indicative of the monitored length. The signals are processed by the evaluating circuit 34 of the monitoring unit, and the output of the circuit 34 transmit signals which cause the driving unit 41 to accelerate or decelerate the feeding unit 22 so as to ensure that the length of the leg 26*a* is at least substantially constant. The wrapping material 6 enters the magazine 27 through the open top between the upper end portions of the sidewalls 27*b* and 27*c*, and successive increments of the leg 26*c* are intermittently withdrawn by a suitable tongs 28 which is oscillatable in directions indicated by a double-headed arrow 28A and is installed in or adjacent to a processing machine PM, e.g., a cigarette packing machine of the type disclosed in commonly owned U.S. Pat. No. 3,956,870 granted May 18, 1976 to Kruse et al. The tongs 28 can be replaced with other suitable means for intermittently withdrawing wrapping material 6 from the magazine 27.

It has been found that, in the absence of any remedial undertaking, the rapidly oscillating tongs 28 agitate the leader (i.e., the loop 26) of the wrapping material 6 to such an extent that parts of the loop do not remain in their prescribed paths and their stray movements affect the accuracy of the rate of intermittent introduction of predetermined lengths of wrapping material 6 into the machine PM.

In accordance with a feature of the invention, the improved apparatus further includes novel means for opposing stray movements of the loop 26 in the magazine 27 irrespective of the frequency of oscillatory movement of the tongs 28. The opposing means comprises an endless foraminous conveyor 40 which is trained over pulleys 43, 44 (rotatably mounted on or rotatable with parallel shafts 43', 44') so that its elongated upright left-hand stretch or reach is adjacent to the sidewall 27*b* of the magazine 27. This sidewall has a cutout so that the left-hand stretch of the conveyor 40 (which is driven by the unit 41 in synchronism with the feeding unit 22 and in a direction such that the outer side of its left-hand stretch travels downwardly) can come into actual contact with and stabilizes the leg 26*a* of the loop 26 in the magazine 27. In other words, the left-hand stretch of the conveyor 40 maintains the adjacent part (leg 26*a*) of the loop 26 in its prescribed path to thus counteract the tendency of the loop 26 to perform stray movements in response to intermittent withdrawal of increments of the other leg 26*c* by way of the open top of the magazine 27.

Figure 2:
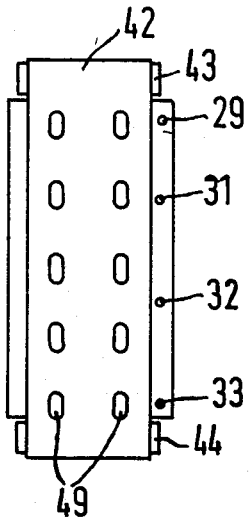
FIG. 2 is an enlarged front elevational view of a first conveyor which can be used in the apparatus to oppose or fully suppress agitation of the loop in the magazine, the view being taken in the direction of arrows as seen from the line I—I of FIG. 1.

As shown in FIG. 2, the conveyor 40 can include a relatively wide endless foraminous belt or band 42 which has apertures 49 so that it permits a suction chamber 46 to draw air through the apertures and to thus attract the leg 26*a* of the loop 26 to the respective stretch of the belt 42. The row of sensors 29, 31, 32, 33 is then adjacent one side of the illustrated stretch of the belt 42.

Figure 3:
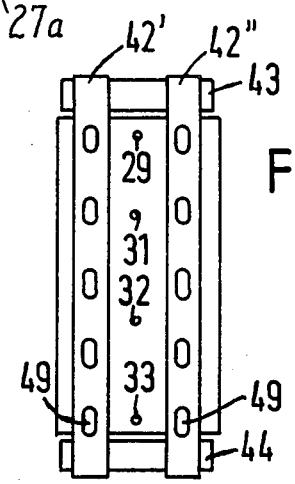
FIG. 3 is a similar front elevational view of a modified conveyor and of a differently mounted loop monitoring unit.

FIG. 3 shows that the relatively wide belt 42 of FIGS. 1 and 2 can be replaced with two narrower belts 42', 42" whose parallel vertical stretches are spaced apart from each other to provide room for the sensors 29, 31, 32 and 33 therebetween. The belts 42' and 42" are also formed with apertures 49 so as to enable the suction chamber 46 to pneumatically attract the adjacent leg 26*a* of the loop 26 when the apparatus employing the structure of FIG. 3 is in actual use.

The suction chamber 46 is connected with the intake of a fan 48 or another suitable suction generating device by one or more conduits 47.

It has been found that the stabilizing action of the opposing means including the conveyor 40, suction chamber 46 and suction generating device 48 is enhanced if the speed of the conveyor 40 slightly exceeds the peripheral speed of the rotary advancing elements 23, 24, i.e., if the leg 26*a* of the loop 26 is tensioned in the region adjacent to the sidewall 27*b* of the magazine 27. The driving unit 41 transmits torque to the upper pulley 43. The operative connections between the driving unit 41 and the feeding unit 22 as well as the pulley 43 are indicated in FIG. 1 by phantom lines.

The improved apparatus is susceptible of many additional modifications without departing from the spirit of the invention. For example, the belt 42 of FIG. 2 or the belts 42', 42" of FIG. 3 can be replaced with a battery of suction wheels with internal suction chambers which attract the leg 26*a* of the loop 26 in the magazine 27 and thus stabilize the entire loop irrespective of the frequency at which the tongs 28 or another suitable withdrawing means advances increments of wrapping material from the leg 26*c* adjacent to the sidewall 27*c* of the magazine. One or more endless belts are preferred at this time because their elongated straight stretches, which are adjacent to the sidewall 27*b*, can invariably stabilize the loop regardless of the rate of consumption of wrapping material by the processing machine PM.

It has been found that the improved apparatus invariably ensures predictable withdrawal of wrapping material from the magazine 27, irrespective of the frequency at which the tongs 28 is caused to oscillate so that the rate at which the machine PM receives such material is more predictable than when using heretofore known apparatus. Moreover, the monitoring unit including the sensors 29, 31, 32, 33 and the evaluating circuit 34 can operate in a more reliable way because that portion of the loop 26 (namely the leg 26*a*) which is being monitored is held in its prescribed path by the assembly of parts 40, 46 and 48 so that the overall length of the loop 26 can be maintained within relatively narrow limits. This, too, contributes to more predictable admission of increments of wrapping material into the processing machine.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for supplying strip-shaped wrapping material to a processing machine, particularly to a packing machine, comprising a source of wrapping material; a magazine; means for feeding wrapping material from said source into said magazine and for converting the wrapping material in the magazine into a loop; means for intermittently withdrawing wrapping material from said magazine with accompanying changes in the dimensions of the loop and an increasing tendency of the loop to become agitated in response to increasing frequency of intermittent withdrawal of wrapping material from the magazine, said magazine including a portion which is adjacent to a part of the loop therein; and means for opposing agitation of the loop, said opposing means being adjacent to said portion of the magazine and acting upon said part of the loop therein, said opposing means comprising an endless foraminous conveyor one side of which is adjacent said portion of the magazine and means for pneumatically urging said part of the loop in said magazine against said side of said conveyor.

2. The apparatus of claim 1, wherein the loop in the magazine has a bight and two legs flanking the bight, said part of the loop being constituted by one of the legs thereof.

3. The apparatus of claim 1, wherein said magazine has a sidewall which constitutes said portion thereof.

4. The apparatus of claim 1, wherein said means for pneumatically urging comprises a suction generating device.

5. The apparatus of claim 1, further comprising means for driving said conveyor at a speed which at least slightly exceeds the speed at which said feeding means delivers wrapping material into said magazine so that said conveyor maintains said part of the loop under tension.

6. The apparatus of claim 1, wherein said conveyor comprises at least one endless foraminous belt.

7. The apparatus of claim 1, further comprising means for monitoring the dimensions of the loop in said magazine, said monitoring means being arranged to monitor the loop in the region of said portion of the magazine.

8. The apparatus of claim 7, wherein said monitoring means comprises a plurality of sensors disposed one after the other, as considered in the direction of feed of wrapping material into said magazine.

9. The apparatus of claim 8, wherein said conveyor comprises an endless foraminous belt having a stretch adjacent said portion of said magazine, said urging means including means for pneumatically attracting said part of the loop to said stretch and said monitoring means being adjacent to one side of said stretch.

10. The apparatus of claim 7, wherein said opposing means comprises two endless foraminous belts having spaced-apart stretches adjacent said portion of said magazine and said urging means includes means for pneumatically attracting said part of the loop to said stretches, said monitoring means being disposed between said stretches.

11. The apparatus of claim 1, wherein said source is disposed above said magazine and said magazine has an open top for admission of wrapping material thereinto and a bottom wall, said portion of said magazine constituting a sidewall adjacent one side of and extending upwardly from said bottom wall and said feeding means cooperating with said magazine to form a loop having a bight adjacent said bottom wall and a pair of legs one of which constitutes said part of the loop and is advanced downwardly by said feeding means, said means for intermittently withdrawing wrapping material from said magazine comprising an oscillating tongs arranged to draw the other leg of the loop through the open top of said magazine.

12. The apparatus of claim 1, wherein said feeding means comprises a pair of rotary advancing elements and further comprising means for driving said conveyor and at least one of said advancing elements in synchronism with said conveyor.

13. The apparatus of claim 12, wherein said driving means is adjustable and further comprising means for monitoring the dimensions of the loop in said magazine and for adjusting said driving means as a function of changes in the dimensions of the loop.

14. The apparatus of claim 13, wherein said monitoring means comprises at least one proximity detector adjacent said portion of said magazine.

15. A method of applying strip-shaped wrapping material to a processing machine, particularly to a cigarette packing machine, comprising the steps of establishing and maintaining a source of supply of wrapping material; feeding the wrapping material from said source at a variable speed along a predetermined path and converting the leader of the advancing wrapping material into a loop having a bight and two legs flanking the bight; intermittently drawing wrapping material from one leg of the loop with accompanying changes in the dimensions and an increasing tendency of the loop to become agitated in response to increasing frequency of intermittent drawing of wrapping material from the one leg; and opposing agitation of the loop, including pneumatically urging the other leg the respective portion of said path.

16. The method of claim 15, wherein said opposing step further includes tensioning the other leg of the loop in the respective portion of said path.

17. The method of claim 15, further comprising the step of monitoring the dimensions of the loop and varying said speed as a function of changes in the dimensions of the loop.

18. The method of claim 15, wherein said opposing step includes conveying the other leg of the loop along the respective portion of said path at a speed which deviates from said variable speed.

* * * * *